US005402648A

United States Patent [19]

Longsworth

[11] Patent Number: 5,402,648

[45] Date of Patent: Apr. 4, 1995

[54] SEALED DEWAR WITH SEPARATE CIRCULATION LOOP FOR EXTERNAL COOLING AT CONSTANT PRESSURE

[75] Inventor: Ralph C. Longsworth, Allentown, Pa.

[73] Assignee: APD Cryogenics Inc., Allentown, Pa.

[21] Appl. No.: 86,164

[22] Filed: Jul. 1, 1993

[51] Int. Cl.[6] ..... F25B 19/00

[52] U.S. Cl. ..... 62/51.1; 62/434; 104/285; 505/897

[58] Field of Search ..... 62/51.1, 51.3, 434; 174/15.1; 104/285; 505/892, 897, 899

[56] References Cited

U.S. PATENT DOCUMENTS

| | | | |
|---|---|---|---|
| 3,363,207 | 1/1968 | Brechna | 62/51.3 X |
| 3,470,828 | 10/1969 | Powell, Jr. et al. | 104/285 |
| 3,708,705 | 1/1973 | Tinlin | 62/51.1 X |
| 3,850,004 | 11/1974 | Vander Arend | 62/51.3 X |
| 3,851,274 | 11/1974 | Solin et al. | 62/51.1 X |
| 3,878,691 | 4/1975 | Asztalos | 62/51.1 X |
| 4,340,405 | 6/1982 | Steyert, Jr. et al. | 62/51.1 |
| 4,578,962 | 4/1986 | Dustmann | 62/51.3 X |
| 4,692,560 | 9/1987 | Hotta et al. | 62/51.1 X |
| 4,713,942 | 12/1987 | Hofmann | 62/51.3 X |
| 4,884,409 | 12/1989 | Quack et al. | 62/51.1 |
| 4,977,749 | 12/1990 | Sercel | 62/51.1 |

FOREIGN PATENT DOCUMENTS

| | | | |
|---|---|---|---|
| 6490 | 1/1977 | Japan | 505/892 |
| 239006 | 11/1985 | Japan | 505/892 |
| 5036526 | 2/1993 | Japan | 505/892 |

OTHER PUBLICATIONS

S. Asstalos, W. Baldus, R. Kneuer, and A. Stephan; "On-board Cryogenic System . . . ", 5th Int. Cry. Eng. Conf.; (Kyoto) May 1974.

Y. Ishizaki et al., "D8 Sealed Cryostat System for Magnetically Levitated Vehicles", Fifth Int'l. Cryogenic Eng. Conf., 1974, pp. 102-105.

*Primary Examiner*—Christopher Kilner

*Attorney, Agent, or Firm*—Helfgott & Karas

[57] ABSTRACT

Apparatus and methods for low pressure cooling of superconducting magnets, for example, on a magnetic levitated train, through a separate circulation loop from a sealed, unvented thermal reservoir to provide a light-weight cooling system. In a second embodiment, forced flow cooling is directed to the superconducting magnets and shields through a separate circulation loop from a sealed thermal reservoir to further reduce the weight of the cooling system.

33 Claims, 6 Drawing Sheets

| TEMP-K | H@1ATM | H SEALED | H@4 ATM |
|---|---|---|---|
| 4.00 | 0.00 | 0.00 | 0.00 |
| 4.20 | 0.00 | 0.00 | 0.00 |
| 4.21 | 21.00 | 0.00 | 0.00 |
| 5.00 | 26.20 | 4.70 | 4.20 |
| 6.00 | 32.40 | 10.50 | 14.00 |
| 7.00 | 38.40 | 16.30 | 27.90 |
| 8.00 | 44.40 | 22.60 | 36.40 |
| 9.00 | 49.80 | 29.20 | 43.50 |

SEALED DEWAR WITH SEPARATE CIRCULATION LOOP FOR EXTERNAL COOLING AT CONSTANT PRESSURE

FIELD OF THE INVENTION

This invention relates to the field of cooling a superconducting magnet. More particularly, the invention relates to a lightweight system and method of operating the system for cooling an external load, such as superconducting magnets on a magnetically levitated train.

BACKGROUND OF THE INVENTION

A magnetically levitated train may be constructed with a plurality of superconducting magnets located in multiple cryostats disposed on either side of swiveled undercarriages, known as bogies, that support the train. The superconducting magnets maybe constructed of Niobium Tin ($Nb_3Sn$) wire because they would then be capable of operating at temperatures as high as 8K. An operating temperature above the normal boiling point of helium, 4.2K, is important because it allows the refrigeration requirement to be effectively provided by a conventional Gifford-McMahon cycle refrigerator. The latter refrigerator can produce refrigeration with reasonable efficiency at a temperature of between about 8K and 10K. Alternatively, the cooling can be provided by forced flow of supercritical helium, having a temperature below about 6K, which has better heat transfer properties and more stable flow characteristics then boiling helium.

Magnetic levitating trains are being considered which can periodically have coolant transferred to the trains from large, stationary refrigerators at service depots. In an alternative design, smaller refrigerators are located on the trains and power is transferred to these refrigerators through the guideways upon which the trains travel. Hybrid system designs are also being considered whereby large, stationary refrigerators provide a portion of the cooling and onboard refrigerators provide the balance. Irrespective of the advantages and disadvantages of each type of cooling system, the weight of the onboard cooling system is a major factor in its selection. Added weight requires larger magnetic fields and higher power requirements.

Typically, magnetically levitated trains use superconducting magnets which operate at less than about ten K and liquid cryogen as a refrigerant to cool the magnets. The prior art suggests the use of cooling systems based on the following technologies: (a) The use of NbTi wire which operates at temperatures of less than 6K to construct the coil for the superconductor magnet. Alternatively, NbSn wire is selected because it operates at temperatures of less than 9K while providing the same field strength as the NbTi wire. However, the NbSn wire is harder to fabricate than the NbTi wire. (b) The coil of the superconductor magnet is cooled by either immersion in liquid or gaseous helium or by forcing liquid or gaseous helium to flow through the wire tubing forming the coil. (c) The cooling system for the magnet is usually provided by a coolant supplied 1) from a refrigerator that is on each car of the train and which receives power from the guideway on which the train travels or 2) from a stationary, central refrigerator that transfers cooling, i.e., low temperature cryogens, to dewars (double walled containers with vacuum between the walls) which contain the superconductor magnets and are carried aboard the trains. The latter type of cooling system includes boil off gas storage facilities on board the train for periodic recovery of the gas.

Studies have been carried out on these different cooling options. $Nb_3Sn$ wire magnets were found to be beneficial because the cooling system was lighter in weight and thereby offset the higher cost associated with the added difficulty in constructing this type of magnet. A heavier cooling system operates by simply cooling the magnets with liquid helium that is permitted to warm from about 4K to 8K. The added weight is primarily attributed to a helium recovery system which receives the boil off helium, compresses the helium and stores it in storage bottles at some higher temperature. The weight of the helium recovery system makes this option heavier than that of simply using a closed cycle refrigerator with or without supplemental liquid cryogen to provide the desired cooling.

Several different cooling systems using liquid helium in a sealed dewar are also known. In one system, the superconducting magnet coils are located in sealed dewars that are designed to withstand a pressure of about 1.8 Mega Pascals (MPa), the pressure in a dewar which has been filled with liquid helium at 0.1 MPa and a temperature of 4.2K and then warmed to 8K. The dewars used in magnetic levitating trains have a flat shape so that they can be mounted within the space provided for them by the construction of the trains. The flat shape of these dewars would require that their sides be constructed of a heavier gauge metal to prevent bending under high operating pressure and they would, accordingly, be heavier in weight then a similar dewar having a round shape. Using a system with a heavy weight is a deficiency because more energy and therefore higher costs are associated with operating the trains.

OBJECTS OF THE INVENTION

It is the object of the present invention to provide a system and method of operating the system for cooling a superconducting magnet by circulating a helium gas through a cooling loop which is in heat transfer relationship with the magnet to obviate the problems and limitations of the prior art systems and methods.

It is a further object of the present invention to provide a system and method of operating the system for cooling superconducting magnets and associated structure on a magnetically levitated train by having a thermal reservoir of helium and a separate cooling loop passing through the reservoir to carry low pressure cooling to the magnets to provide a lightweight cooling system.

It is still a further object of the present invention to provide a system and method of operating the system for cooling superconducting magnets by circulating a pressurized helium gas with a pump in a thermal reservoir of helium through separate cooling loop passing through the reservoir to carry low pressure cooling to the magnets and reduce the weight of the cooling system.

SUMMARY OF THE INVENTION

In accordance with the preferred embodiment of the invention, a system for cooling an external load comprises a sealed dewar containing a first cryogen that is periodically cooled, a cooling loop means connecting the sealed dewar and the external load for circulating a second cryogen through the sealed dewar to the external load whereby the external load is cooled, and pump means within the sealed dewar to elevate the pressure of the second cryogen and circulate the second cryogen to the external load at a substantially constant pressure whereby the external load is effectively cooled. The second cryogen is cooled by circulating it through a heat exchanger within the sealed dewar and its pressure is elevated by the pump means from about 0.3 MPa to about 0.4 MPa. The sealed dewar is filled with liquid helium having a temperature of between 4K and a pressure of about 0.1 MPa.

According to the invention, a method for cooling an external load, comprises the steps of periodically cooling a sealed dewar containing a first cryogen, circulating a second cryogen through a closed cooling loop connecting the sealed dewar and the external load whereby the external load is cooled, and elevating the pressure of the second cryogen within the sealed dewar to circulate the second cryogen to the external load at a substantially constant pressure whereby the external load is effectively cooled. The method also includes the steps of cooling the second cryogen by circulating the second cryogen through a heat exchanger within the sealed dewar and elevating the pressure of the second cryogen from about 0.3 MPa to about 0.4 MPa. The method also includes the step of filling the sealed dewar with liquid helium having a temperature of about 4K and a pressure of about 0.1 MPa.

In accordance with another embodiment of the invention, there is provided a method and apparatus of cooling an external load, such as superconducting magnets and warm shields, comprising a sealed dewar containing a first cryogen that is periodically cooled and cooling loop means connecting the sealed dewar and the external load for circulating a second cryogen at essentially constant pressure through the sealed dewar to the external load whereby the external load is cooled. The sealed dewar is preferably filled with liquid helium having a temperature of about 4.2K and a pressure of about 0.1 MPa and is designed to increase to a temperature of about 8K and a pressure of about 1.8 MPa. Preferably the second cryogen is helium gas at a pressure of about 0.4 MPa, and is circulated in the loop means by a cold pump.

According to the invention, a cold box contains the sealed dewar containing a first cryogen and cooling loop with a second cryogen for cooling cold shields located adjacent the superconducting magnets. The cooling loop passing through the sealed dewar to reduce the temperature of helium gas circulating the through closed loop. The cooling loop means includes a plurality of sections which carry the helium gas in a path from the cold pump located in or near the sealed dewar, through the 1) lower part of the sealed dewar, (2) to the superconducting magnets, (3) into the cold shields, (4) to the top of the sealed dewar, and (5) back through the cold pump to complete the path.

Also in accordance with the invention, a method for cooling superconducting magnets and warm shields comprises the steps of periodically cooling a sealed dewar containing a first cryogen and circulating a second cryogen at essentially constant pressure through a closed cooling loop connecting the sealed dewar and the external load to cool the external load. The method includes the step of filling the sealed dewar with liquid helium having a temperature of about 4.2K and pressure of about 0.1 MPa which can warm to about 8K and a pressure of about 1.8 MPa. In addition, the second cryogen is helium gas at a pressure of about 0.3 MPa.

In accordance with the invention the method includes the steps of providing a cold box containing the sealed dewar containing the first cryogen and a second cryogen for cooling the superconducting magnets and cold shields located adjacent thereto, and then flowing through the cooling loop to the sealed dewar to reduce the temperature of helium gas circulating through the closed loop.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
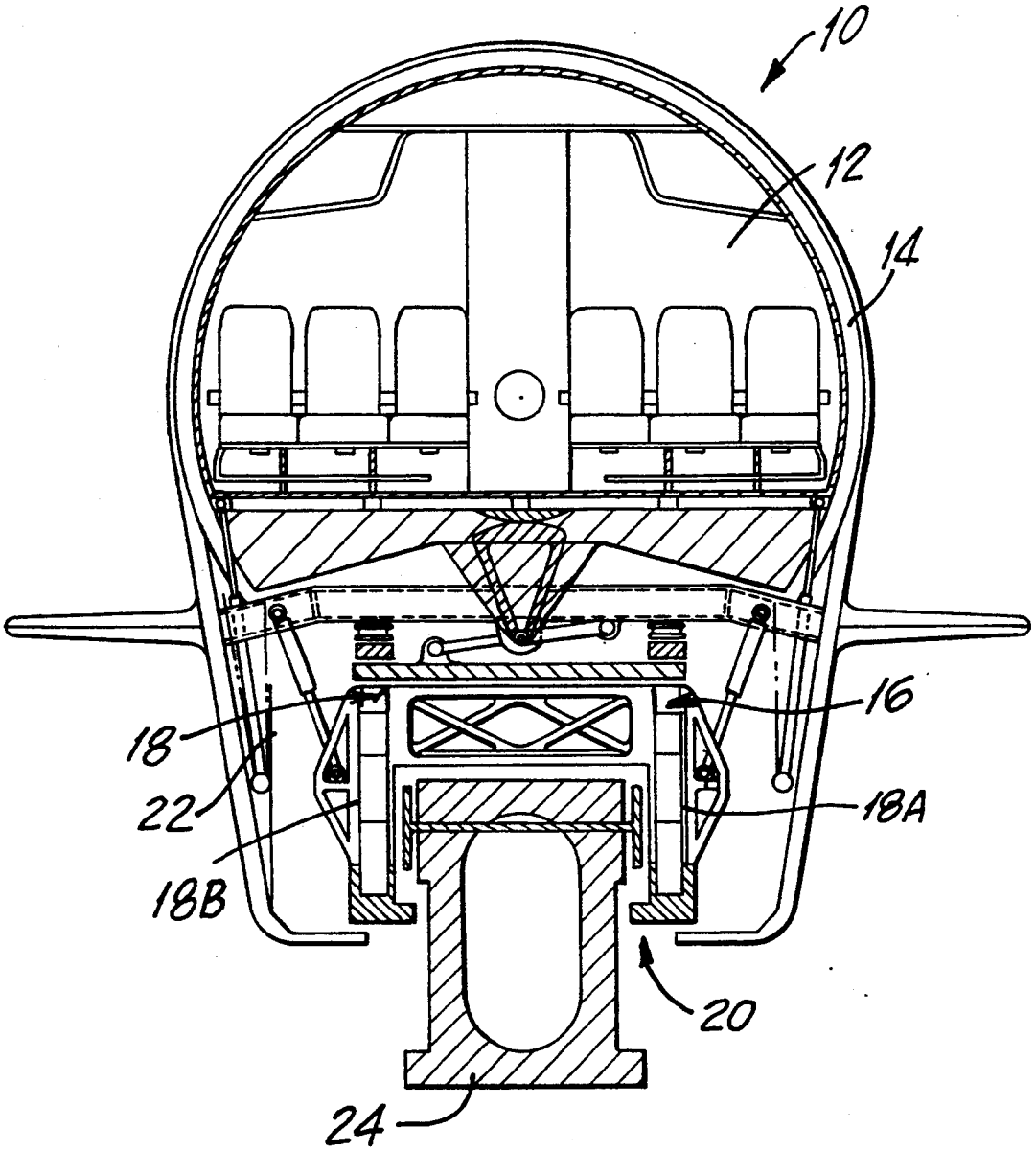
FIG. 1 is a schematic cross sectional, end view of a magnetically levitated train showing the location of the superconducting magnets, in accordance with the invention.

Referring to FIG. 1 there is shown a schematic of a magnetic levitated car 10 having a passenger compartment 12 in the upper section 14 and first and second pluralities of cryostats 16 and 18 on either side of a swiveled undercarriage or bogie 20 secured within a lower section 22 of car 10. Each plurality of cryostats 16 and 18 contain a plurality of superconducting magnets (not shown), for example eight magnets in each, The superconducting magnets are located in individual flat dewars. In a possible car 10, six bogies 20 are provided to articulate relative thereto. Each bogie 20 can have two cryostats 16 and 18 which are attached to opposite sides of car 10 and which operate as a pair. That is, the magnets carried by paired cryostats 16 and 18 are either energized or deenergized at the same time. The cryostats 16 and 18 are disposed on either side of guideway 24 and enable car 10 to travel along guideway 24 without physical contact between guideway 24 and cryostats 16 and 18 containing the superconducting magnets. As conventionally known, superconducting magnets are located and cooled in individual dewars 18A and 18B containing low temperature, liquid helium, i.e., at a temperature of less than about 9 K, in order to create the superconducting conditions which are critical to the operation of magnetically levitated cars 10.

Figure 2:
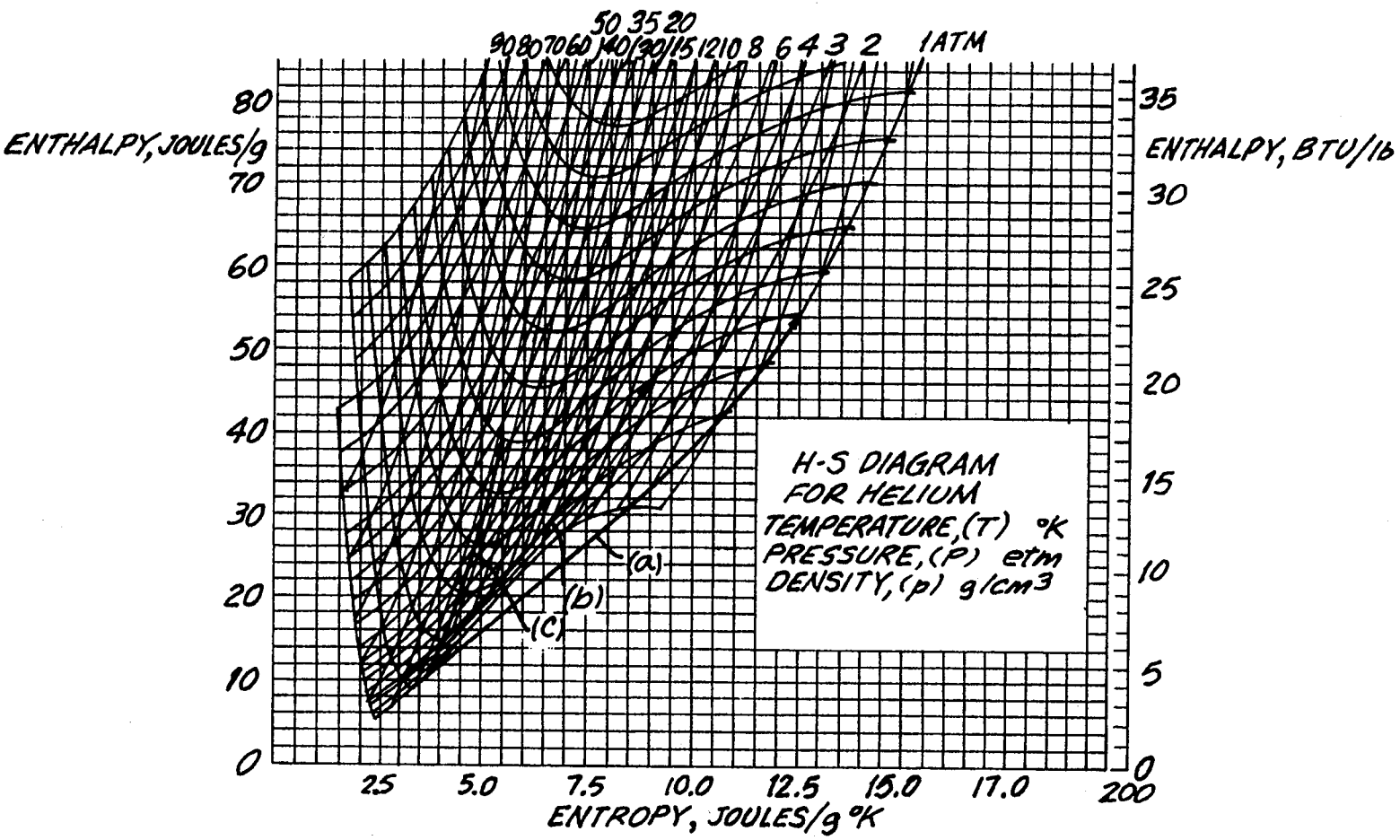
FIG. 2 is an Enthalpy-Entropy Diagram for helium.
Figure 3:
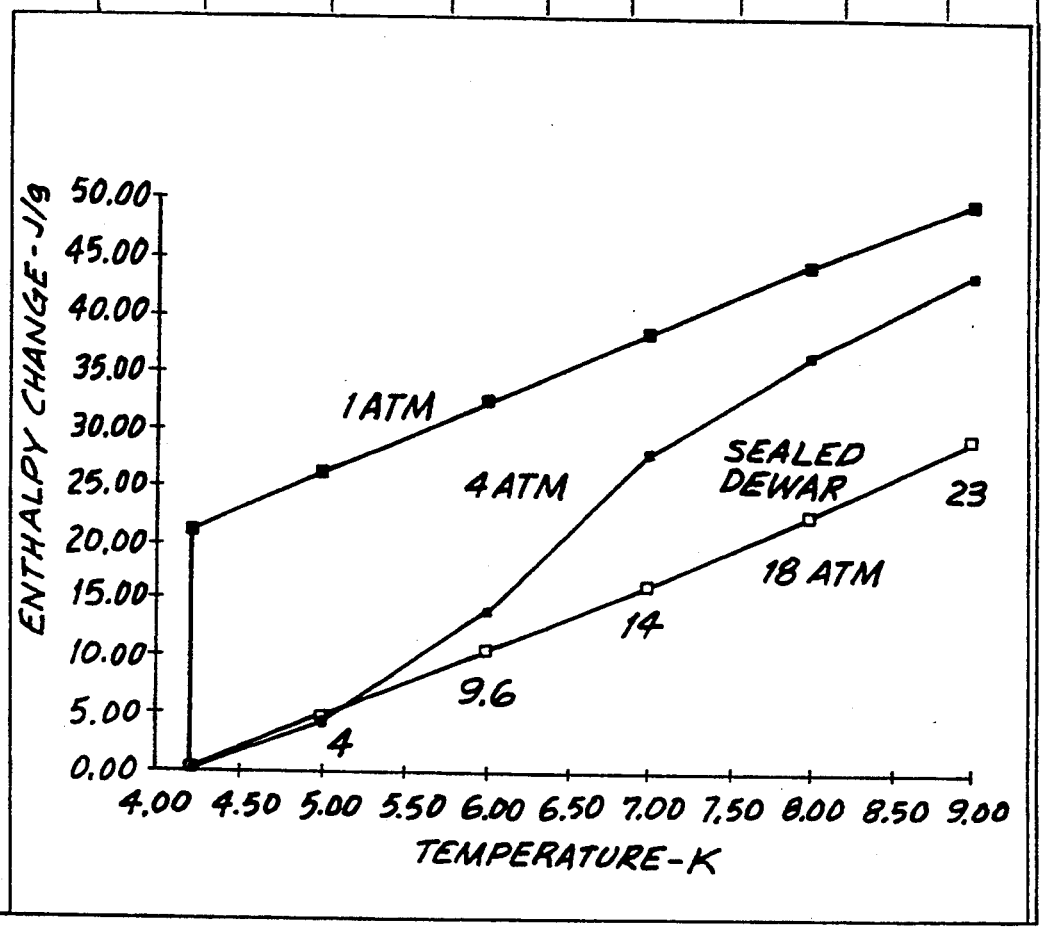
FIG. 3 is an Enthalpy versus Temperature Diagram for helium.

Referring to FIGS. 2 and 3, there is illustrated the effect of adding heat to liquid helium, such as the heat generated by an external load, like a superconducting magnet located in a dewar that is filled with liquid helium. FIG. 2 is an enthalpy-entropy diagram for helium and FIG. 3 is an enthalpy versus temperature diagram for helium. Both of these diagrams show the process lines for helium warming from a temperature of 4.2K to 8K at (a) a constant pressure of 0.1 MPa (1 atmosphere), (b) a constant pressure of 0.4 MPa (4 atmospheres), and c) in a sealed dewar, i.e., where the density of the liquid helium is constant and the pressure increases from 0.1 MPa to 1.8 MPa (18 atmospheres). FIGS. 2 and 3 demonstrate that the most refrigeration (change of enthalpy) results from warming at a constant pressure of 0.1 MPa, a lesser amount of refrigeration results from warming between a temperature of 4.2K to 8K at a constant pressure of 0.4 MPa, and the least amount of refrigeration results from warming in a sealed dewar. Helium at a constant pressure 0.1 MPa initially boils and then becomes a gas which can absorb the most heat in warming to 8K. However the heat transfer characteristics of helium at this pressure are poor. Conversely, helium at a constant pressure of 0.4 MPa absorbs less heat while warming to 8K but the heat transfer characteristics at this pressure are much better. Thus, helium circulated at 0.4 MPa, such as by forced flow cooling through a superconducting magnet, gives better cooling and is preferred over the lower pressure helium because the higher pressure helium is denser, has a higher mass flow rate for a given pressure drop, and does not have flow and temperature instabilities relating to boiling. Also, denser helium is easier to circulate through smaller channels. In designing superconducting magnets, it is desirable to keep the diameter of the wire very small and to actually force the helium to flow through a channel in the wire. By increasing the pressure of the helium, a higher mass flow rate can be achieved with a lower pressure drop. The result is better heat transfer.

While it is shown that the sealed dewar can not absorb as much heat as either case, just discussed, where the pressure is held constant, this deficiency is offset by elimination of the need for a separate recovery system to collect the helium which must be vented as the temperature rises in order that the pressure remains constant. A recovery system typically includes apparatus to compress the liquid helium and place into storage tanks after the helium reaches the upper limit of its useful temperature range. Then, the helium gas is periodically transferred to stationary plants off of the train for recycling. The recovery system adds undesirable weight to the car.

Figure 4:
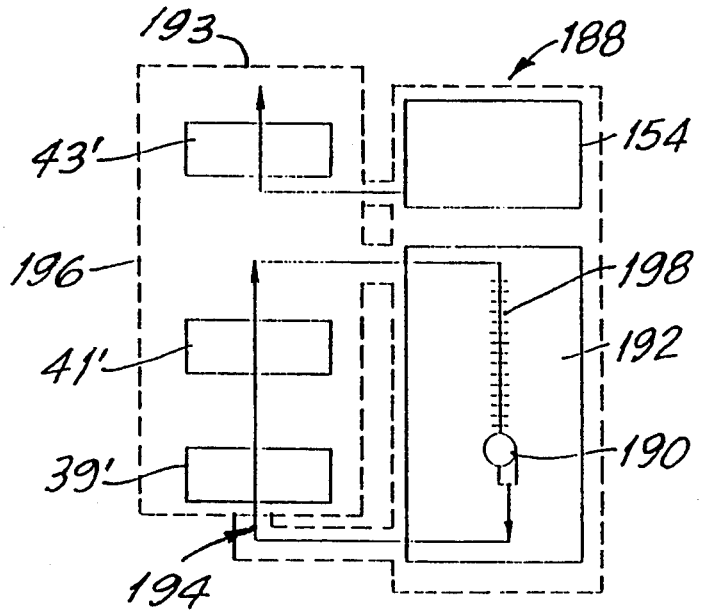
FIG. 4 is a preferred embodiment of the invention wherein liquid helium in a sealed dewar is circulated by a pump in the dewar.

In accordance with the present invention, a preferred embodiment, as illustrated in FIG. 4, is a system 188 which includes a circulating pump 190 mounted in the bottom of a sealed helium dewar 192. The system 188 is enclosed in a vacuum container 193 for insulation. Pump 190 elevates the pressure of helium gas being circulated through a closed, circulating loop 194 from about 0.3 MPa to about 0.4 MPa. The compressed helium is cooled down to the temperature of liquid helium at the bottom of sealed dewar 192, i.e., between 4K to 6K, before flowing out through the vacuum insulated conduits forming circulating loop 194 to the superconducting magnets 39' discussed in detail below, disposed within cryostat 196. Throughout the specification, primed and double primed reference numerals represent structural elements which are substantially identical to structural elements represented by the same unprimed reference numerals. Circulating loop 194 extends through cold shield 41' so that the helium gas flows through cold shield 41' subsequent to flowing through magnet 39'. The circulation rate through circulating loop 194 is controlled so that helium gas is warmed to about 8 K by the time it leaves cold shield 41'. The pressure drop from 0.4 MPa to about 0.3 MPa is due to the helium gas being forced through the small diameter metal coils of magnet 39'. It then flows back into the top of dewar 192 and down through a heat exchanger coil 198 into pump 190 at the bottom of dewar 192 to complete the closed circulating loop 194. A reservoir of liquid nitrogen 154 is shown directly connected to warm shield 43' so as to be allowed to exhaust.

Typically, a cryostat includes a superconducting magnet 39 surrounded by a cold shield 41 to keep the magnet cold. Also a warm shield 43 is disposed about cold shield 41 to prevent heat from the ambient to significantly increase heat flow to the region.

According to the invention, the flow pattern through system 188 is such that the helium at the top of sealed dewar 192 is warmed before the helium in the bottom of dewar 192 which remains at a temperature near 4.2K because of the stratification throughout most of the operating period of system 188. This means that for the majority of time, the helium entering magnet 39' is near 4.2K and the circulation rate is low. Only toward the end of a given period of operation does the circulation rate, i.e., the speed of pump 190, have to be increased to compensate for higher temperatures of helium gas leaving dewar 192.

Figure 5:
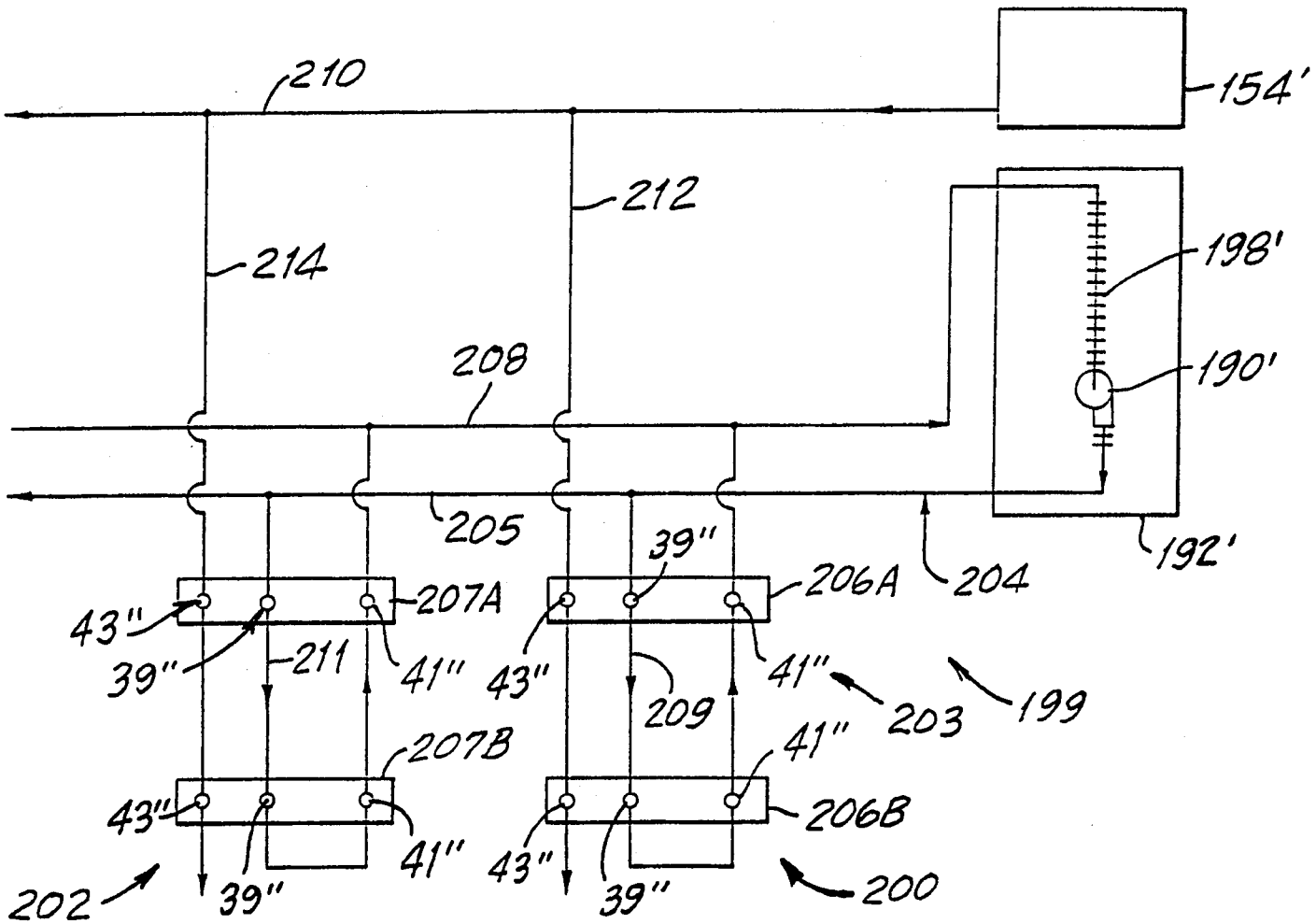
FIG. 5 is a flow schematic of a second embodiment wherein liquid helium in a sealed dewar is circulated by a pump, as illustrated in FIG. 4, and used to cool the superconducting magnets in a magnetically levitated train.

FIG. 5 shows a hybrid system 199 applied to a magnetically levitated train having at least first and second bogies 200 and 202 which are in a cooling system 203 that incorporates structure similar to system 188 illustrated in FIG. 4. That is, after exiting pump 190', the pressurized helium gas at a pressure of 0.4 MPa circulates through flow lines of a closed cooling loop 204 wherein the flow lines are vacuum jacketed (not shown) to prevent heat transfer. The pressurized helium gas leaves dewar 192' and flows into a first section 205 which extends past cryostats 206A, 206B and 207A, 207B which are secured to each bogie 200, 202, respectively, along the length of the car. The helium gas flows from section 205 through lines 209 and 211 into magnets 39'' and cold shields 41'' in bogies 200 and 202. Then the helium gas flows into a section 208 through which it returns back into the top of dewar 192'. Finally, the helium gas flows down from the upper warm end to a lower cold end of heat exchanger coil 198' into pump 190' to complete the cooling loop 204. The reservoir of liquid nitrogen 154' has a flow line 210 which extends the length of the car and is directly connected by parallel flow lines 212 and 214 to warm shields 43''.

The system 199 incorporating a cold circulating pump 190', as shown in FIG. 5, is believed to be lighter in weight than a third embodiment, system 230 of FIG. 6 as discussed below, because there are fewer heat losses. It is also believed to be lighter in weight than other known cooling options that use onboard refrigerators without considering the weight of the necessary power conversion equipment.

Figure 7:
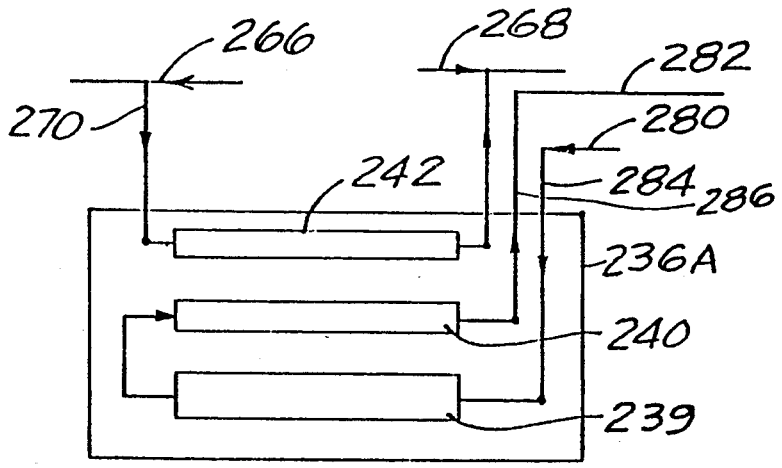
FIG. 7 is a schematic illustration of a cryostat housing a superconducting magnet, a warm shield and a cold shield.
Figure 6:
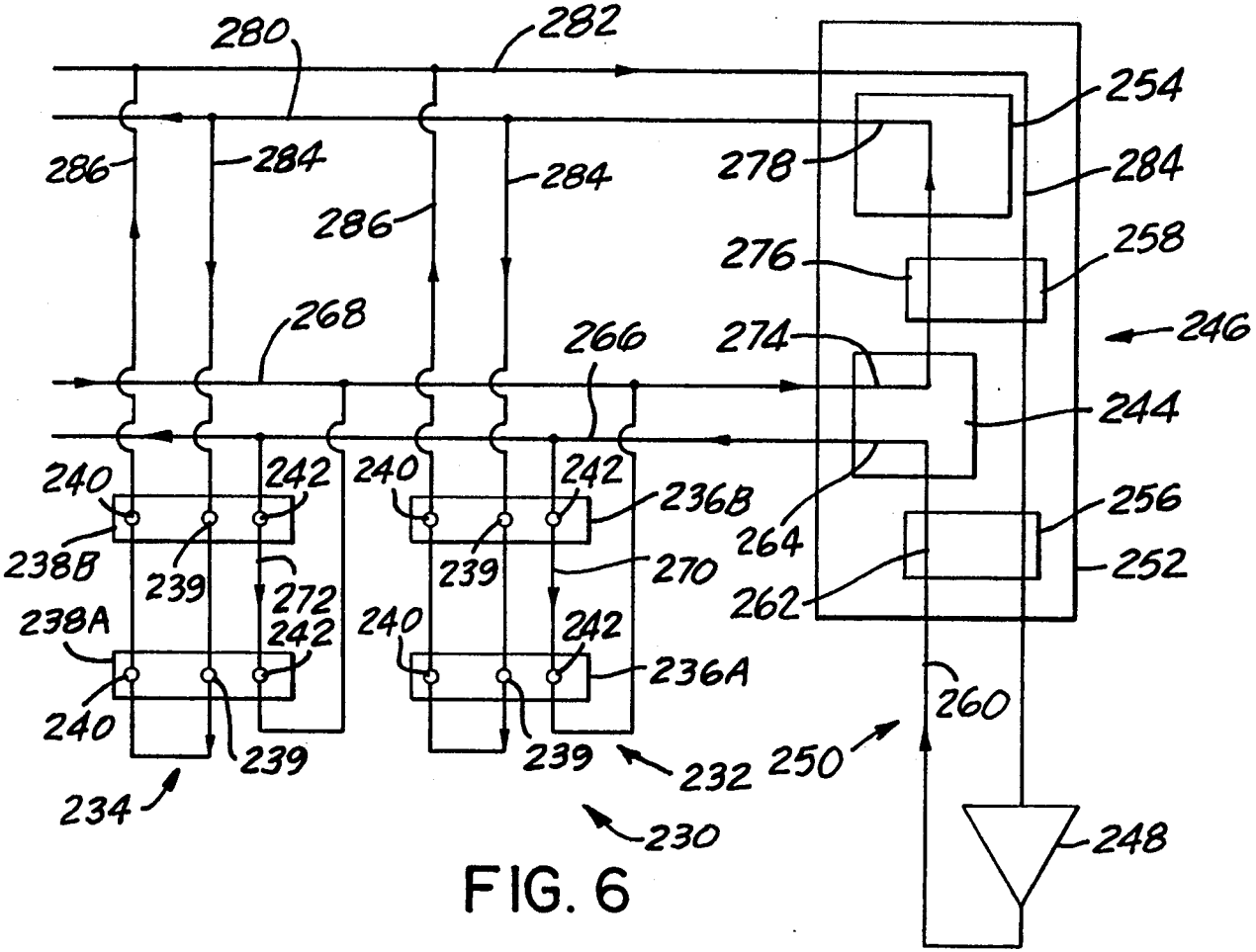
FIG. 6 is a flow schematic of a third embodiment for a sealed helium dewar a liquid nitrogen circuit and a recycle compressor to pump helium gas.

A third embodiment of the present invention is a system 230, as illustrated in FIGS. 6 and 7, which includes a plurality of schematically illustrated bogies 232 and 234, each of which includes two pairs of cryostats 236A,236B and 238A,238B disposed on opposite sides of the guideway along which the car travels. Cryostats 236A,236B and 238A,238B are substantially identical in construction and comprise vacuum chambers containing a plurality of flat coiled, superconducting magnets 239 which are substantially identical to magnets 39, cold shields 240 and warm shields 242. While only one magnet, cold shield and warm shield are illustrated, it is understood that a plurality of each can be located in each cryostat. These are cooled by flowing cold helium through them at 0.4 MPa. Helium which has been cooled by a reservoir of cryogen 244, i.e. LN2, flows through the warm shields 242 and helium cooled to 4.2 to 8K flows through the magnets 239 then the cold shields 240.

An important aspect of the invention relates to the means 246 for circulating a second helium gas through the cryostats 236A,236B and 238A,238B containing superconducting magnets 239. As illustrated in FIG. 6, a compressor 248 conveniently located on the car at room temperature, circulates the second helium gas through a closed cooling loop 250. Cooling loop 250, at a location downstream of compressor 248, initially enters a vacuum filled cold box 252 containing a sealed dewar 254 filled with first cold helium, first and second counter-flow, heat exchangers 256 and 258 that conserve refrigeration provided by the cold helium in sealed dewar 254, and a reservoir 244 of a cryogen, such as liquid nitrogen, which cools the second helium gas that flows to warm shields 242 which are disposed in cryostats 236A,236B, 238A,238B, as shown in FIG. 7, to thermally isolate the low temperature regions of the magnets from higher temperatures regions. Reservoir 244 is allowed to vent the nitrogen as it absorbs heat and turns into gas. Both sealed dewar 254 of helium and reservoir 244 of liquid nitrogen act as thermal sinks. The circulating helium then flows through heat exchanger 258, sealed dewar 254, magnets 239, cold shields 240, heat exchangers 258 and 256 and back to compressor 248.

Referring to FIG. 6, a description of the flow path of closed cooling loop 250 follows. After exiting compressor 248, a first section 260 of cooling loop 250 enters cold box 252. Next, a second section 262 of loop 250 passes through heat exchanger 256 to transfer heat to the returning gas. Then, a third section 264 of loop 250 enters reservoir 244 to reduce the temperature of the helium flowing through closed loop 250. Next, fourth section 266 of loop 250 extends past each of the cryostats secured to each bogie 232,234 along the length of the car and a fifth section 268 returns to cold box 252. While only two bogies are shown, it is within the terms of the invention to use any desired number of bogies, conventionally six for each car.

Parallel flow lines 270 and 272, which are connected at one end to fourth section 266 and at the other end to fifth section 268 of loop 250, direct the flow of helium through cryostats 236A,236B and 238A,238B, respectively, to cool warm shields 242, as illustrated in FIG. 7. As shown, lines 270 and 272 cool warm shields 242 on opposite sides of bogies 232 and 234. Upon reentering cold box 244, a sixth section 274 of cooling loop 250, again passes through reservoir 244 to reduce the temperature of the helium flowing through closed loop 250. Next, a seventh section 276 of cooling loop 250 passes through heat exchanger 258 to transfer heat to the returning helium. A eighth section 278 of loop 250 passes through sealed dewar 254 so that heat is transferred from the helium gas circulating through loop 250 into the cold helium at the top of dewar 254 and then at a lower temperature into the colder helium at the bottom of dewar 254 prior to exiting dewar 254.

An important aspect of the present invention relates to sealed dewar 254 being periodically, typically once a day, filled with liquid helium at a temperature of 4.2K and a pressure of 0.1 MPa. As heat is introduced to the top of dewar 254 by the flow of helium gas through cooling loop 250, the helium stored in dewar 254 stratifies so that the densest, coldest helium remains at the bottom of dewar 254 and the warmer helium, which is usually in a gaseous state, rises to the top of dewar 254. As the operation of the system proceeds and heat continues to transfer into dewar 254, the pressure and temperature of the helium within dewar 254 both rise. It is important that the temperature within dewar 254 not rise so high that the helium gas circulating through loop 250 exits at a temperature exceeding 8K. For example, if at the beginning of operation, the circulating helium gas enters into dewar 254 through eighth section 278 at a temperature of 4K and exits at a temperature of 8K, there is no need to rapidly circulate the helium gas within loop 250. However, as the period of operation continues, the circulating helium gas warms and can enter dewar 254 at 6K. Since the helium gas must exit at a temperature of 8K in order that the magnets 239 are cooled so as to remain superconductive, the flow rate of the helium gas is increased by compressor 248 to maintain a constant exit temperature.

Continuing on, a ninth section 280 of closed loop 250 extends past each of the cryostats secured to each bogie 232, 234 along the length of the car and then a tenth section 282 returns to cold box 252. Parallel flow lines 284 and 286, which are connected at one end to ninth section 280 and at the other end to tenth section 282 of loop 250, direct the flow of helium gas through cryostats 236A,236B and 238A,238B, respectively, to cool the one or more flat coiled, superconducting magnets 239 and then the cold shields 240 therein. As shown in FIGS. 6 and 7, lines 284 and 286 are downstream of lines 270 and 272 and also cool the magnets 239 on opposite sides of bogies 232 and 234 because they can only operate in pairs, as previously discussed. Upon reentering cold box 252, the eleventh section 284 of cooling loop 250, again passes through heat exchangers 258 and 256, respectively, to receive heat from the inflowing helium and minimize the amount of refrigeration needed to cool the incoming circulating helium gas through section 260.

To further understand the operation of system 230, an exemplary system is described with approximations of the temperatures which can be expected at each section. The helium gas circulating through closed loop 250 exits compressor 248 and enters cold box 252 through a first section 260 at a temperature of 300K. Next, a second section 262 of loop 250 passes through heat exchanger 256 and the helium gas, upon exiting has a temperature of 78K. A third section 264 of loop 250 enters reservoir 244 and exits at a temperature of 77K. The helium gas continues its flow through fourth section 266 and then into fifth section 268 which returns to cold box 252. Parallel flow lines 270 and 272, which are connected at one end to fourth section 266 and at the other end to fifth section 268 of loop 250, direct the flow of helium gas through warm shields 242 in cryostats 236A,236B and 238A,238B, respectively, and the returning helium gas mixes with the circulating helium flow through section 268 so as to enter reenter cold box 252 at a temperature of 85K. The helium gas flow continues through a section 274 and again passes through reservoir 244 to reduce the temperature of the helium gas to 77K. Next, the helium gas flows through a seventh section 276 which passes through heat exchanger 258 and exits at a temperature of 8.2K. Continuing, the helium gas flows through a eighth section 278 which passes through sealed dewar 254 and exits at a temperature of between about 4.2K to 6K. The helium gas in ninth section 280 of loop 250 flows to the end of the cryostats and returns in tenth section 282 to cold box 252. Parallel flow lines 284 and 286, which are connected at one end to ninth section 280 and at the other end to tenth section 282 of closed loop 250, direct the flow of helium through the superconducting magnets 239 and the cold shields 240 then rejoin the helium flow through section 282 to reenter cold box 252 and flow down section 284 at a temperature of 8K. Subsequent to flowing through heat exchanger 258, the temperature of helium gas increases to 76K and after passing through heat exchanger 256 reaches a temperature of 298K. While the system 230 provides effective cooling of the cryostats, it may operate at somewhat different temperatures.

While the invention has been described in terms of using liquid helium within a sealed dewar 254, the same principles would apply if liquid neon or liquid hydrogen were substituted to provide cooling at temperatures of about 30K or 20K, respectively.

The wire used at present to construct superconducting magnets requires liquid or cold gaseous helium to cool the magnet to the operating temperature. However, under circumstances when higher temperature, superconducting wire becomes available, it is anticipated that it can be cooled with higher temperature cryostats, such as neon at a temperature of about 30K. Irrespective of the case, the gas is valuable and should be conserved by use in a closed cycle refrigerator or by recovering the gas subsequent to the liquid warming after being used to provide cooling. Hydrogen might also be used for temperatures of about 20K in which case it is undesirable to vent it to the atmosphere for reasons of safety.

It is apparent that there has been provided in accordance with this invention systems and methods for low pressure transfer of cooling to superconducting magnets on a magnetic levitated train through a separate circulation loop from a sealed thermal reservoir to provide a lightweight cooling system that satisfies the objects, means and advantages set forth hereinbefore. In a second preferred embodiment, forced flow cooling is directed to the superconducting magnets through a separate circulation loop from a sealed thermal reservoir to further reduce the weight of the cooling system.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A system for cooling an external load, comprising:
a sealed unvented dewar containing a fixed quantity of a first cryogen that is to be periodically recooled;
cooling loop means connecting said sealed dewar and said external load in a loop for circulating a second cryogen through said sealed dewar to be cooled therein by transferring heat to said first cryogen and to said external load to cool said external load; and
pump means to circulate said second cryogen in said loop to said external load at a substantially constant pressure and at a flow rate whereby said external load is effectively cooled.

2. The system of claim 1 wherein said second cryogen is cooled by circulating through a heat exchanger within said sealed dewar.

3. The system of claim 2 wherein said pump means elevates the pressure of said second cryogen from about 0.3 MPa to about 0.4 MPa, said second cryogen being gaseous helium.

4. The system of claim 1 wherein said sealed dewar is filled with liquid helium having a temperature of about 4K and a pressure of about 0.1 MPa, which warms to a temperature of about 8K and a pressure of about 1.8 MPa.

5. The system of claim 1 wherein said sealed dewar is filled with a cryogen selected from the group comprising liquid helium, liquid hydrogen and liquid neon.

6. The system of claim 1 wherein said external load is at least one superconducting magnet and at least one warm shield.

7. The system of claim 1 wherein said cryogen in said sealed dewar is recooled by flowing cold cryogen from a separate storage tank.

8. The system of claim 2 wherein said heat exchanger for cooling said second cryogen in said sealed dewar has a warm end and a cold end, and said heat exchanger is oriented with said warm end at a top of said dewar and said cold end at a bottom of said dewar.

9. The system of claim 1 wherein the pump means is located within said sealed dewar.

10. A method for cooling an external load, comprising the steps of:
periodically cooling a sealed unvented dewar containing a fixed quantity of a first cryogen;
circulating a second cryogen through a cooling loop to said sealed dewar to be cooled therein by said first cryogen and to said external load to cool said external load; and
circulating said second cryogen to said external load at a substantially constant pressure and a flow rate whereby said external load is effectively cooled.

11. The method of claim 10 including the step of cooling said second cryogen by circulating said second cryogen through a heat exchanger within said sealed dewar.

12. The method of claim 10 including the step of elevating the pressure of said second cryogen from about 0.3 MPa to about 0.4 MPa, said second cryogen being helium gas.

13. The method of claim 10 including the step of filling said sealed dewar with a first cryogen comprising liquid helium having a temperature of about 4K and a pressure of about 0.1 MPa and allowing it to warm to about 8K and a pressure of about 1.8 MPa.

14. The method of claim 10 including the step of filling said sealed dewar with a first cryogen selected from the group comprising liquid helium, liquid hydrogen and liquid neon.

15. The method of claim 10 including the step of elevating the pressure of said second cryogen by means of a pump in said cooling loop within said sealed dewar.

16. A system for cooling an external load, comprising:

a sealed unvented dewar containing a fixed quantity of a first cryogen that is to be periodically recooled; and cooling loop means connecting said sealed dewar and said external load in a loop for circulating a second cryogen at essentially constant pressure through said sealed dewar to be cooled and to said external load to cool said external load.

17. The system of claim 16 wherein said first cryogen is initially liquid helium having a temperature of about 4.2K and a pressure of 0.1 MPa, which warms to about 8K and a pressure of 1.8 MPa.

18. The system of claim 16 wherein said sealed dewar is filled with said first cryogen selected from the group comprising liquid helium, liquid hydrogen and liquid neon.

19. The system of claim 17 wherein said second cryogen is helium gas at a pressure of about 0.3 MPa.

20. The system of claim 19 wherein said helium gas is circulated in said loop means by a compressor at room temperature.

21. The system of claim 16 wherein said external load is at least one superconducting magnet and at least one cold shield.

22. The system of claim 21 further including:

a cold box containing said sealed dewar containing said first cryogen and a reservoir of a third cryogen for cooling said at least one cold shield located adjacent said at least one superconducting magnet; and said cooling loop means passing through said reservoir to reduce the temperature of said second cryogen circulating through said closed loop.

23. The system of claim 22 wherein said cooling loop means includes a plurality of sections which carry said second cryogen in a path from said compressor located external to said cold box, through said reservoir, into at least one warm shield adjacent said at least one cold shield, back to said reservoir, to said at least one superconducting magnet, to said at least one cold shield, to said sealed dewar, and back through said compressor to complete said path.

24. The system of claim 23 wherein said cold box further includes first and second heat exchangers, and said second cryogen in said plurality of sections of said path of said cooling loop means passes through said first and second heat exchangers to transfer heat in said cold box.

25. The method for cooling an external load, comprising the steps of:

periodically cooling a sealed unvented dewar containing a fixed quantity of a first cryogen; and circulating a second cryogen at essentially constant pressure through a cooling loop connecting said sealed dewar, where said second cryogen is cooled, and said external load to cool said external load.

26. The method of claim 25 including the step of filling said sealed dewar with a first cryogen of liquid helium having a temperature of about 4.2K and a pressure of about 0.1 MPa and allowing said first cryogen to warm to about 8K and a pressure of about 1.8 MPa.

27. The method of claim 25 including the step of filling said sealed dewar with a first cryogen selected from the group comprising liquid helium, liquid hydrogen and liquid neon.

28. The method of claim 27 including the step of selecting said second cryogen to be a helium gas at a pressure of about 0.3 MPa.

29. The method of claim 25 including the step of selecting said external load to be at least one superconducting magnet and at least one warm shield.

30. The method of claim 29 including the steps of:

providing a cold box containing said sealed dewar holding said first cryogen, and containing a reservoir of a third cryogen for cooling said at least one warm shield located adjacent each of said at least one superconducting magnet; and passing said cooling loop through said reservoir to reduce the temperature of said second cryogen circulating through said closed cooling loop.

31. The method of claim 30 including the steps of: circulating said second cryogen through said cooling loop in a path from said compressor located external to said cold box, through said reservoir, into said at least one warm shield, back to said reservoir, to said at least one superconducting magnet, to said sealed dewar and back through said compressor to complete said path.

32. The system of claim 1 wherein said pump means elevates said second cryogen to a selected pressure that enhances heat transfer characteristics of the second cryogen.

33. The method of claim 10, further comprising the step of raising the pressure of said second cryogen to a selected pressure that enhances heat transfer characteristics of said second cryogen.

* * * * *